US010224599B2

(12) United States Patent
Zhong et al.

(10) Patent No.: US 10,224,599 B2
(45) Date of Patent: Mar. 5, 2019

(54) WIFI ANTENNA DEVICE

(71) Applicant: Molex, LLC, Lisle, IL (US)

(72) Inventors: Guang-Yong Zhong, Shanghai (CN); Soon-Kuan Tan, Shanghai (CN)

(73) Assignee: Molex, LLC, Lisle, IL (US)

( * ) Notice: Subject to any disclaimer, the term of this patent is extended or adjusted under 35 U.S.C. 154(b) by 45 days.

(21) Appl. No.: 15/451,988

(22) Filed: Mar. 7, 2017

(65) Prior Publication Data

US 2017/0288296 A1 Oct. 5, 2017

(30) Foreign Application Priority Data

Mar. 31, 2016 (CN) ..... 2016 1 0196020

(51) Int. Cl.

| | |
|---|---|
| ***H01Q 1/22*** | (2006.01) |
| ***H01Q 1/36*** | (2006.01) |
| ***H01Q 1/48*** | (2006.01) |
| ***H01Q 21/30*** | (2006.01) |

(52) U.S. Cl.

CPC ..... *H01Q 1/2291* (2013.01); *H01Q 1/2258* (2013.01); *H01Q 1/2266* (2013.01); *H01Q 1/36* (2013.01); *H01Q 1/48* (2013.01); *H01Q 21/30* (2013.01)

(58) Field of Classification Search

CPC .. H01Q 1/2258; H01Q 1/2266; H01Q 1/2291; H01Q 1/36; H01Q 1/48; H01Q 21/30; H01Q 21/20

See application file for complete search history.

(56) References Cited

U.S. PATENT DOCUMENTS

| | | | | |
|---|---|---|---|---|
| 7,050,010 | B2 | 5/2006 | Wang et al. | |
| 7,425,924 | B2 | 9/2008 | Chung et al. | |
| 7,737,907 | B2 | 6/2010 | Tsai et al. | |
| 2012/0098707 | A1* | 4/2012 | Chou | H01Q 9/42 343/700 MS |
| 2014/0266972 | A1* | 9/2014 | Yang | H01Q 1/243 343/893 |

FOREIGN PATENT DOCUMENTS

| | | | |
|---|---|---|---|
| CN | 103682585 | A | 3/2014 |

* cited by examiner

*Primary Examiner* — Hoang V Nguyen
(74) *Attorney, Agent, or Firm* — Molex, LLC

(57) ABSTRACT

The present disclosure discloses a WIFI antenna device, the WIFI antenna device includes a carrier, a grounding portion, a first radiation portion, a second radiation portion and a third radiation portion which all are provided on the carrier. The first radiation portion, the second radiation portion and the third radiation portion are coupled to the grounding portion. The coupling portion couples an electrical signal to the first radiation portion, the second radiation portion and the third radiation portion. The first radiation portion, the second radiation portion and the third radiation portion convert the electrical signal into the radiation signal. The first radiation portion determines a low frequency resonance point of a radiation signal emitted by the WIFI antenna device. The second radiation portion determines a first high frequency resonance point of the radiation signal. The third radiation portion determines a second high frequency resonance point of the radiation signal.

23 Claims, 9 Drawing Sheets

WIFI ANTENNA DEVICE

RELATED APPLICATIONS

This application claims priority to Chinese Application No. 201610196020.X, filed Mar. 31, 2016, which is incorporated herein by reference in its entirety.

TECHNICAL FIELD

The present disclosure relates to a WIFI antenna device, and particularly relates to a WIFI antenna device using an indirect feed mode.

BACKGROUND ART

With rapid development of electronic products, habits of consumers are correspondingly changed. Consumers' pursuit of beautiful appearances always is the direction and motivation that manufacturers are working on. In recent years, electronic products develop toward lightness and thinness and at the same time pursue a metal shell design. Laptops also pursue the metal shell design to meet market demand. However, this brings a difficulty to the design of an antenna.

The metal shell brings a great challenge for the antenna, since the metal shell will reduce a bandwidth and efficiency of the antenna. In addition, laptops become more and more thin, which also brings a challenge for the bandwidth of the antenna. Under the above conditions, if a conventional antenna design is used, such as a planar inverted-F antenna (PIFA), an inverted F-shaped antenna (IFA) or a monopole antenna can not meet a broadband requirement of WIFI. A person skilled in the art has attempted to adopt the above conventional antennas, but these antennas cannot meet the broadband requirement of WIFI. Therefore, the present disclosure designs a unique antenna pattern to meet the broadband requirement of WIFI by using an indirect feed mode.

The description in background as above merely is used to provide a background art, and it does not admit that the description on the background art as above discloses the object of the present disclosure, and do not constitute a prior art of the present disclosure, and any description in background as above shall not be acted as any part of the present disclosure.

SUMMARY

In an embodiment of the present disclosure, a WIFI antenna device is provided. The WIFI antenna device includes a carrier, a grounding portion, a first radiation portion, a second radiation portion and a third radiation portion. The grounding portion is provided on the carrier. The first radiation portion is provided on the carrier and is coupled to the grounding portion. The first radiation portion determines a low frequency resonance point of a radiation signal emitted by the WIFI antenna device. The low frequency resonance point defines a bandwidth of 2.4-2.84 GHz. The second radiation portion is provided on the carrier and is coupled to the grounding portion. The second radiation portion determines a first high frequency resonance point of the radiation signal. The third radiation portion is provided on the carrier and is coupled to the grounding portion. The third radiation portion determines a second high frequency resonance point of the radiation signal. The first high frequency resonance point and the second high frequency resonance point define a bandwidth of 4.9-5.85 GHz. The coupling portion couples an electrical signal to the first radiation portion, the second radiation portion and the third radiation portion, the first radiation portion, the second radiation portion and the third radiation portion convert the electrical signal into the radiation signal.

In an embodiment, a length of the coupling portion less than one fourth of a wavelength corresponding to an operative frequency of the radiation signal.

In another embodiment, the coupling portion is not used to convert the electrical signal into the radiation signal.

In an embodiment of the present disclosure, a shape of the coupling portion is any one of a T-shape, a L-shape and a minus sign shape.

In another embodiment, the coupling portion respectively electrically couples with a L-shaped structure and a T-shaped structure.

In still another embodiment, the first radiation portion includes a part. The third radiation portion includes a part. The coupling portion is parallel to the part of the first radiation portion, and is parallel to the part of the third radiation portion.

In yet another embodiment, a length of the first radiation portion is one fourth of a wavelength corresponding to the low frequency resonance point, a length of the second radiation portion is one fourth of a wavelength corresponding to the first high frequency resonance point, a length of the third radiation portion is one fourth of wavelength corresponding to the second high frequency resonance point.

In further another embodiment, the length of the first radiation portion is longer than the length of the second radiation portion, and a vertical part of the T-shaped structure is shared by the first radiation portion and the second radiation portion.

In an embodiment, the coupling portion, the first radiation portion, the second radiation portion, the third radiation portion and the grounding portion are provided on a surface of the carrier.

In an embodiment, the grounding portion is electrically connected to a metal plate of an electrical product, the metal plate acts as a reference grounding of the WIFI antenna device.

In another embodiment, the coupling portion is independent of any one of the first radiation portion, the second radiation portion, the third radiation portion and the grounding portion.

In still another embodiment, the whole coupling portion is positioned on a first surface of the carrier, and the first radiation portion, the second radiation portion, the third radiation portion each have a first part on the first surface of the carrier and a second part on a second surface of the carrier.

In another embodiment, when the first surface and the second surface are developed on the same plane, at least one of the second part of the first radiation portion and the second part of the second radiation portion is positioned above the coupling portion.

In still another embodiment, when the first surface and the second surface are developed on the same plane, the second part of the third radiation portion is positioned above the coupling portion.

In an embodiment, any one of the whole first radiation portion, the whole second radiation portion and the whole third radiation portion is positioned on the same surface.

Technical features and advantages of the present disclosure are widely summarized as above, so as to better understand the following detailed description. Other technical features making up technical solutions of the claims of the present disclosure and other advantages will be described below. A person skilled in the art of the present disclosure shall understand that the concept and specific embodiments disclosed below may be easily used to modify or design other configuration or manufacturing approach so as to realize the same object as the present disclosure. A person skilled in the art of the present disclosure shall also understand that, such an equivalent configuration or approach cannot be departed from the spirit and scope of the present disclosure defined by the appended claims.

BRIEF DESCRIPTION OF THE DRAWINGS

The various respects of the present disclosure may be best understood by the following detailed description taken in connection with the accompanying Figures. It should be noted that, according to a standard implementing mode of the industries, features are not drawn as the scale. In practice, for the sake of clear explanation, various features may be arbitrarily enlarged or reduced in dimension.

DETAILED DESCRIPTION OF THE PREFERRED EMBODIMENTS

The following disclosure content provides various embodiments or exemplifications used to implement various features of the present disclosure. Specific examples of elements and arrangements are described as follows, so as to simplify the disclosed content of the present disclosure. Certainly, these are merely examples, and are not used to limit the present disclosure. For example, in the following description, that a first feature is formed on or above a second feature may include an embodiment that the first feature and the second feature are formed to directly contact with each other, may also include an embodiment that other feature is formed between the first feature and the second feature, therefore the first feature and the second feature do not directly contact with each other. Moreover, the present disclosure may allow a symbol and/or a character of an element to be repeated in different examples. The repetition is used for simplification and clearness, but is not used to dominate a relationship between various embodiments and/or discussed structures.

Moreover, the present disclosure may use spatial corresponding terminologies, such as "below", "lower than", "relative lower", "higher than", "relative high" and the like, so as to describe a relationship between an elements or feature and another element or feature. Spatial corresponding terminologies are used to include various orientations of a device in use or operation besides orientations illustrated in Figures. The device may be orientated (rotated by 90 degrees or at other orientation), and the corresponding spatial description in the present disclosure may be correspondingly explained. It should be understood that, when a feature is formed to another feature or above a substrate, other feature may presented between them.

Figure 1A:
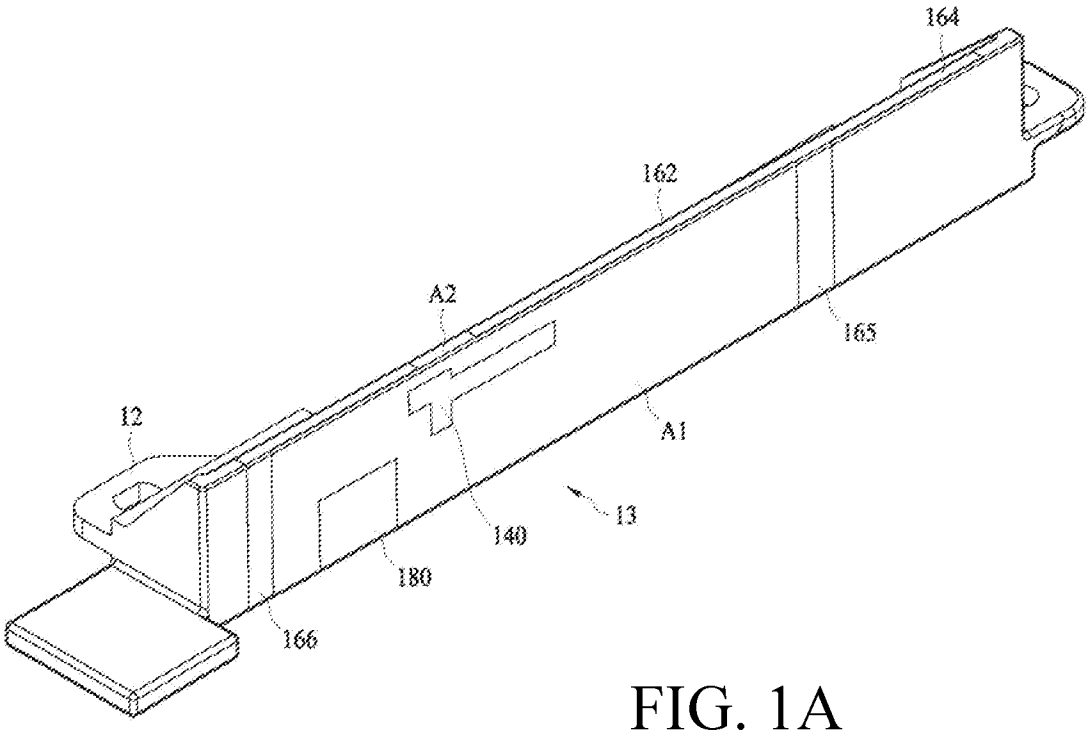
FIG. 1A is a perspective view of a WIFI antenna device of an embodiment of the present disclosure viewed from a side.

FIG. 1A is a perspective view of a WIFI antenna device 1 of an embodiment of the present disclosure viewed from a side, in which WIFI is a wireless local area network technology established depending on the IEEE 802.11 standard. Referring to FIG. 1A, the WIFI antenna device 1 includes a carrier 12 and a patterned conductive layer 13. The patterned conductive layer 13 is provided on the carrier 12 and defines a coupling portion 140, a first radiation portion 162, a second radiation portion 164, a third radiation portion 166 and a grounding portion 180.

The coupling portion 140 is provided on a first surface A1 of the carrier 12. An end of the coupling portion 140 is connected to a wireless radio frequency emitter (not shown) of an electronic device (not shown) via a radio frequency transmitting line (not shown), for example a coaxial cable, or a microstrip line, or the other suitable line, and thus receives an electrical signal provided by the wireless radio frequency emitter. The coupling portion 140 couples the electrical signal to the first radiation portion 162, the second radiation portion 164 and the third radiation portion 166 by using the indirect feed mode with respect to the electrical signal. In the present disclosure, the indirect feed refers to that, in structure, the coupling portion 140 is independent of any one of the first radiation portion 162, the second radiation portion 164 and the third radiation portion 166. Therefore, in electricity, the coupling portion 140 is not short-circuited to any one of the first radiation portion 162, the second radiation portion 164 and the third radiation portion 166. Using the indirect feed technique, a radiation signal emitted by the WIFI antenna device 1 can have a wider bandwidth. Moreover, the coupling portion 140 is also independent of the grounding portion 180. In the embodiment, a shape of the coupling portion 140 is a T-shape, however the present disclosure is not limited to this. Although the shape of the coupling portion 140 in the embodiment is not a perfect T-shape, however a person skilled in the art can undoubtedly understand that the shape of the coupling portion 14 is a T-shape from a structure of the coupling portion 140.

In some existing WIFI antenna devices, a direct feed technique is used. The direct feed refers to that the radio frequency transmitting line for transferring the electrical signal is short-circuited (that is, directly connected) to the radiation portion (for example the first-third radiation portions 162-166 in the present disclosure). However, such a feed mode will make a bandwidth of the radiation signal relative narrow.

Figure 2B:
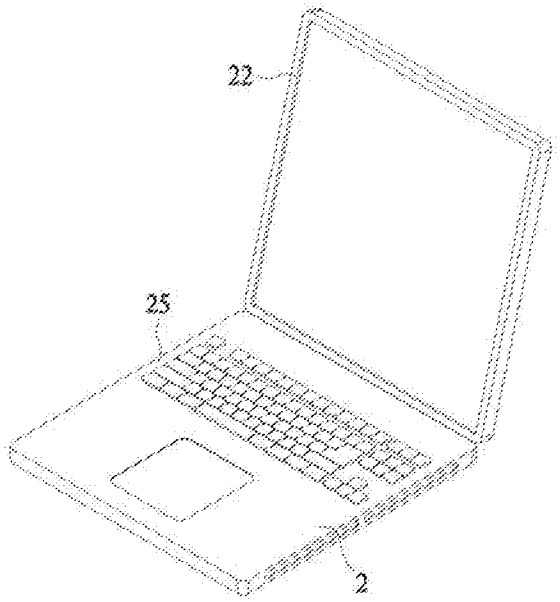
FIG. 2B is a diagrammatic view of the FIG. 1B mounted to a laptop.
Figure 2A:
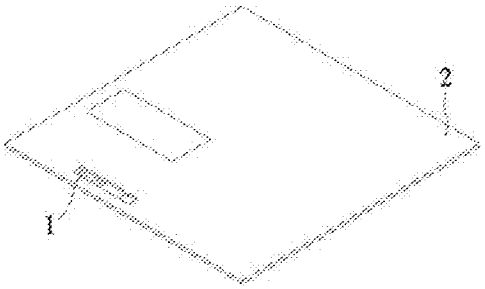
FIG. 2A is a diagrammatic view of the WIFI antenna device of FIG. 1B mounted to a metal plate.
Figure 3:
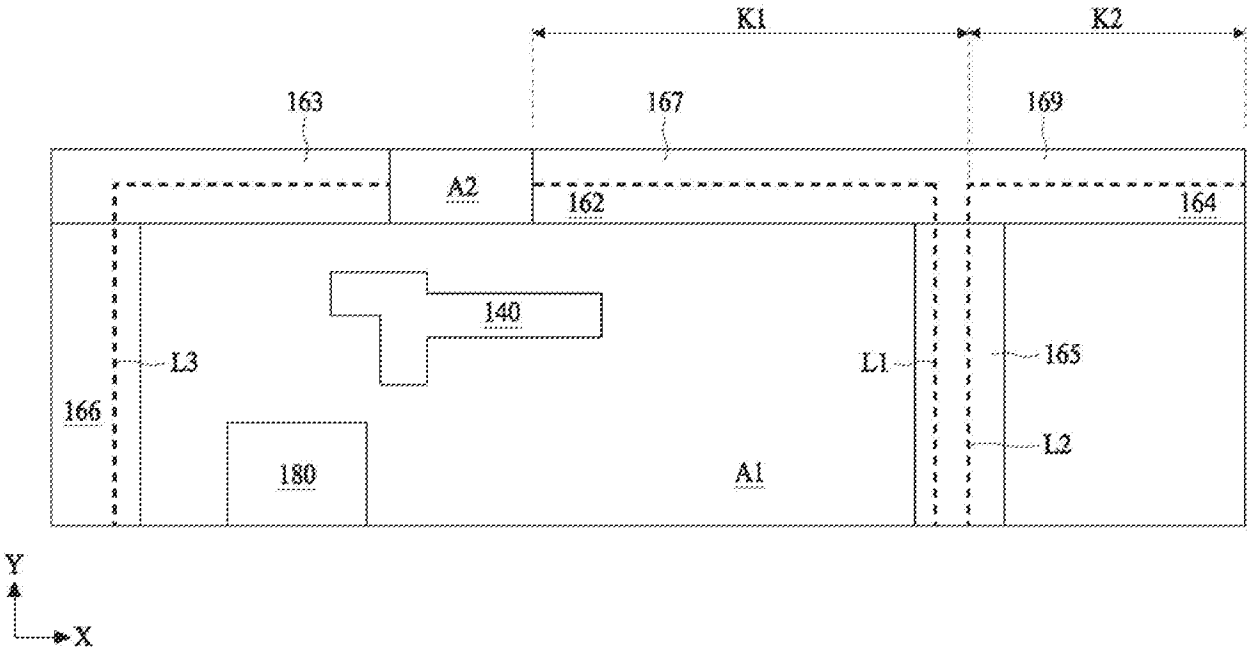
FIG. 3 is a diagrammatic view of a first surface and a second surface of a carrier in FIG. 1A after developed.
Figure 4:
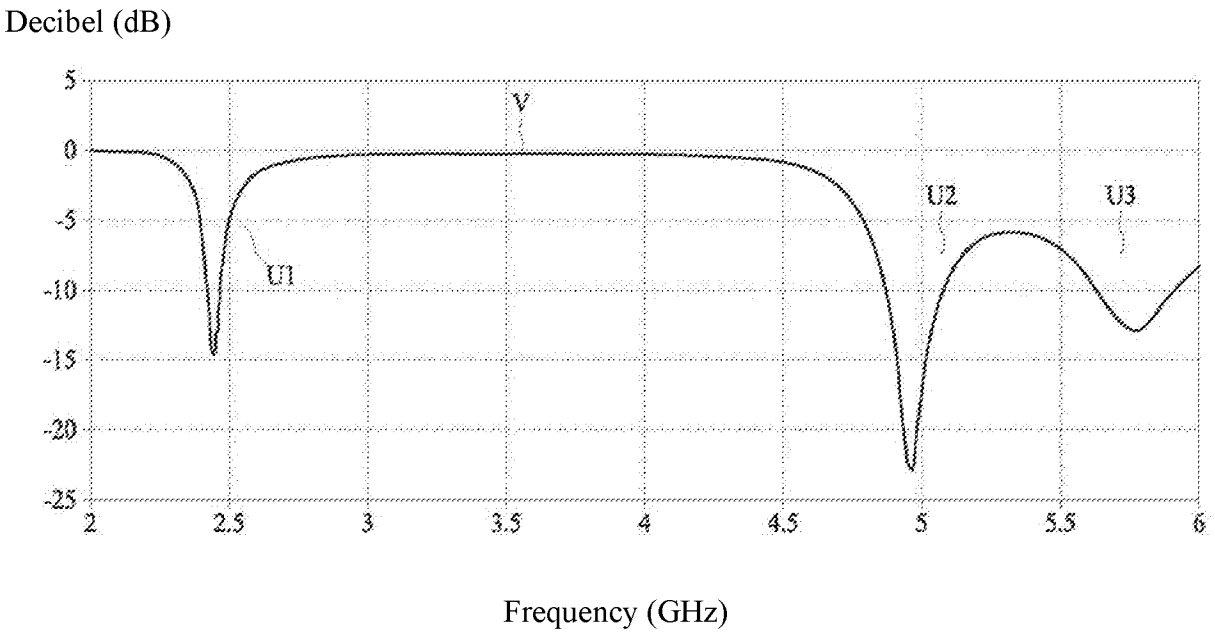
FIG. 4 is a return loss diagram of the WIFI antenna device in FIG. 1A.

The first radiation portion 162 determines a low frequency resonance point of the radiation signal emitted by the WIFI antenna device 1, the second radiation portion 164 determines a first high frequency resonance point of the radiation signal, the third radiation portion 166 determines a second high frequency resonance point of the radiation signal, these will be respectively shown in detail FIG. 3 and FIG. 4. In some embodiments, the second high frequency signal is higher than the first high frequency signal. The grounding portion 180 provides a reference grounding electrical potential, which will be shown in detail FIG. 1B, FIG. 2A and FIG. 2B.

Figure 1B:
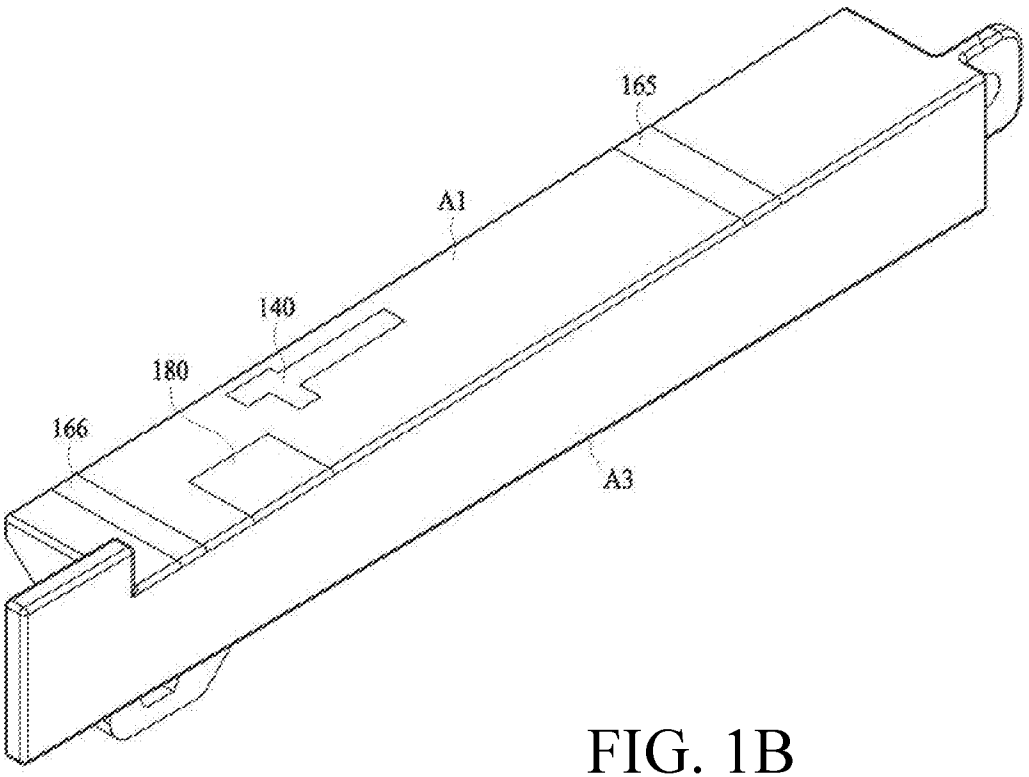
FIG. 1B is the WIFI antenna device of FIG. 1A viewed from another side.

FIG. 1B is the WIFI antenna device 1 of FIG. 1A viewed from another side. Referring to FIG. 1B, the grounding portion 180 is not only provided on the first surface A1 of the WIFI antenna device 1, but also is provided on the third surface A3 adjacent to the first surface A1. In some embodiments, the third surface A3 is orthogonal to the first surface A1. In structure, both a part 165 shared by the first radiation portion 162 and the second radiation portion 164 and the third radiation portion 166 are directly connected to the grounding portion 180 provided on the third surface A3. Therefore, in electricity, the first radiation portion 162, the second radiation portion 164, the third radiation portion 166 and the grounding portion 180 have the same electrical potential. Moreover, a part of the grounding portion 180 positioned on the third surface A3 of the carrier 12 may be connected to a metal plate via a double-side conductive adhesive tape or other double-side conductive structure, thereby providing a reference grounding electrical potential.

FIG. 2A is a diagrammatic view 1 of the WIFI antenna device 1 of FIG. 1B mounted to a metal plate 2. Referring to FIG. 2A, the grounding portion 180 of the WIFI antenna device 1 is connected to the metal plate 2.

FIG. 2B is a diagrammatic view of the WIFI antenna device 1 of FIG. 1B mounted to a laptop 22. Referring to FIG. 2B, the laptop 22 has the metal plate 2 as shown in FIG. 2A. The WIFI antenna device 1 is mounted below the metal plate 2 (under a position indicated by reference numeral 25).

FIG. 3 is a diagrammatic view of the first surface A1 and the second surface A2 of the carrier in FIG. 1A after developed. Referring to FIG. 3, in order to clearly understand a pattern of the patterned conductive layer 13, the first surface A1 and the second surface A2 are developed on the same plane.

The first radiation portion 162 has a length L1. The length L1 is one fourth of a wavelength corresponding to the low frequency resonance point. Therefore, the length L1 of the first radiation portion 162 determines the low frequency resonance point of the radiation signal. The low frequency resonance point is adjusted by adjusting the length L1. For example, when the low frequency resonance point is about 2.4 GHz, the corresponding wavelength is about 125 mm. In this case, the length L1 is about 31.25 mm. In some embodiments, the low frequency resonance point defines a bandwidth of 2.4-2.84 GHz.

Moreover, the part 165 of the first radiation portion 162 (the part 165 is shared by the first radiation portion 162 and the second radiation portion 164) is provided on the first surface A1 of the carrier 12, the other part 167 of the first radiation portion 162 is provided on the second surface A2. In some embodiments, the whole first radiation portion 162 is positioned on the same surface. The part 167 of the first radiation portion 162 extends a length K1 in a first direction X, and the part 165 extends in a second direction Y. In some embodiments, the first direction X is orthogonal to the second direction Y. When the first surface A1 and the second surface A2 are developed on the same plane, the part 167 of the first radiation portion 162 is positioned above the coupling portion 140, and is parallel to the coupling portion 140. Therefore, the coupling portion 140 and the first radiation portion 162 may be deemed as parallel structures.

The second radiation portion 164 has a length L2. The length L2 is one fourth of a wavelength corresponding to the first high frequency resonance point. Therefore, the length L2 of the second radiation portion 164 determines the first high frequency resonance point of the radiation signal. The first high frequency resonance point is adjusted by adjusting the length L2. Moreover, the part 165 of the second radiation portion 164 (the part 165 is shared by the second radiation portion 164 and the first radiation portion 162) is provided on the first surface A1 of the carrier 12, the other part 169 of the second radiation portion 164 is provided on the second surface A2. In some embodiments, the whole second radiation portion 164 is positioned on the same surface. The part 169 extends a length K2 in the first direction X, the length K2 is less than the length K1. Under a case that other structures are not changed, when the shared part 165 moves in the X direction toward the coupling portion 140 so as to make the length K1 less than the length K2, the first radiation portion 162 and the second radiation portion 164 are interchanged in function, in other words, the first radiation portion 162 is changed to determine the first high frequency resonance point and the second radiation portion 164 is changed to determine the low frequency resonance point. The first radiation portion 162 and the second radiation portion 164 define a T-shaped structure. A vertical part (that is, the part 165) of the T-shaped structure is shared by the first radiation portion 162 and the second radiation portion 164.

Third radiation portion 166 has a length L3. The length L3 is one fourth of a wavelength corresponding to the second high frequency resonance point. Therefore, the length L3 of the third radiation portion 166 determines the second high frequency resonance point of the radiation signal. The second high frequency resonance point is adjusted by adjusting the length L3. The first high frequency resonance point determined by the second radiation portion 164 and the second high frequency resonance point determined by the third radiation portion 166 together define a bandwidth. In an embodiment, a range of the bandwidth is 4.9-5.85 GHz.

Moreover, a part (not indicated by any reference numeral) of the third radiation portion 166 is provided on the first surface A1 of the carrier 12, the other part 163 is provided on the second surface A2. In some embodiments, the whole third radiation portion 166 is positioned on the same surface. The part 163 of the third radiation portion 166 extends in the first direction X. When the first surface A1 and the second surface A2 are developed on the same plane, the part 163 of the third radiation portion 166 is positioned above the coupling portion 140, and is parallel to the coupling portion 140. Therefore, the coupling portion 140 and the third radiation portion 166 may be deemed as parallel structures.

The whole coupling portion 140 is positioned on the first surface A1. A length of the coupling portion 140 is designed to less than one fourth of a wavelength corresponding to an operative frequency (for example the low frequency resonance point, the first high frequency resonance point or the second high frequency resonance point). Therefore, the coupling portion 140 does not have the function of the radiation portions 162, 164, 166. Specifically, the coupling portion 140 only couples the electrical signal to the first radiation portion 162, the second radiation portion 164 and the third radiation portion 166 but does not act as the radiation portion for radiating a radiation signal.

FIG. 4 is a return loss diagram of the WIFI antenna device 1 in FIG. 1A. Referring to FIG. 4, a vertical axis represents frequency, a horizontal axis represents decibel. A curve V has three valleys U1, U2 and U3. The valley U1 is defined by the low frequency resonance point which is determined by the first radiation portion 162 in FIG. 3. The valley U2 is defined by the first high frequency resonance point which is determined by the second radiation portion 164 in FIG. 3. The valley U3 is defined by the second high frequency resonance point which is determined by the third radiation portion 166 in FIG. 3. The valley U1 defines a low frequency range required by the WIFI standard, that is a bandwidth of about 2.4-2.84 GHz. The valley U2 and the valley U3 define a high frequency range required by the WIFI standard, that is a bandwidth of about 4.9-5.85 GHz.

Figure 5:
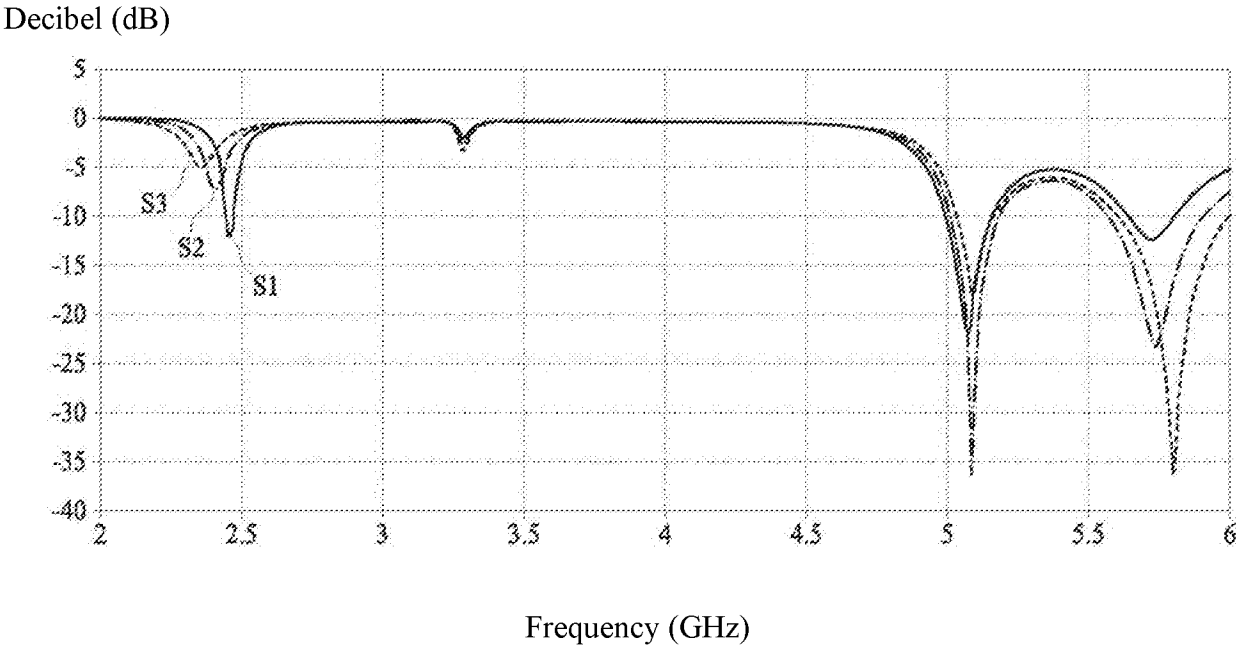
FIG. 5 is a return loss diagram of the WIFI antenna device in FIG. 1A with a coupling portion having different lengths.

FIG. 5 is a return loss diagram of the WIFI antenna device 1 in FIG. 1A with the coupling portion 140 having different lengths. Referring to FIG. 5, a vertical axis represents frequency, a horizontal axis represents decibel. A curve S1 represents a case that the coupling portion 140 is reduced by 1 mm relative to an original length of the coupling portion 140. A curve S2 represents a case that the coupling portion 140 is at the original length of the coupling portion 140. A curve S3 represents a case that the coupling portion 140 is increased by 1 mm relative to the original length of the coupling portion 140. As described above, the coupling portion 140 does not have the function of the radiation portions. In comparison with the curves S1, S2 and S3, it can be further demonstrated that, the effect of the length of the coupling portion 140 on the three resonance frequencies is relative small.

Figure 6:
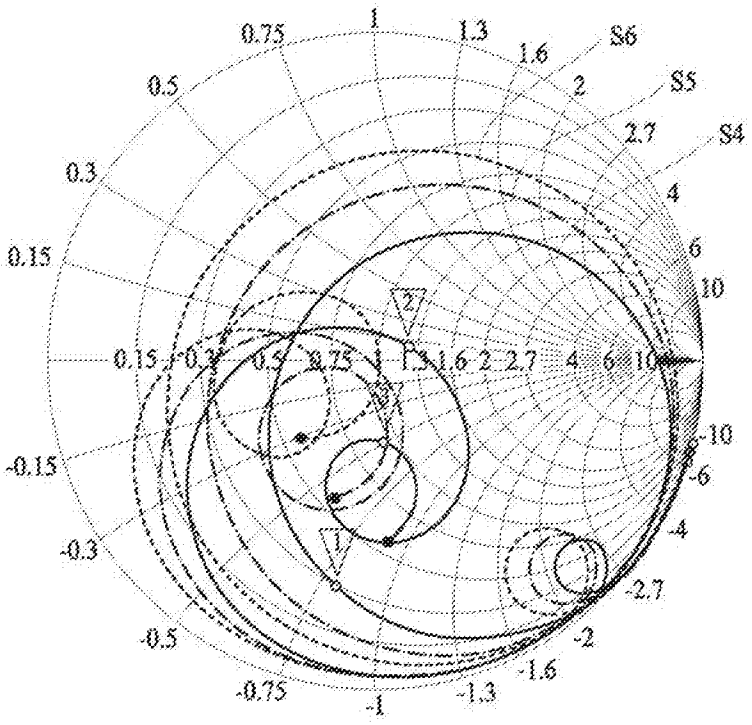
FIG. 6 is an impedance plot of the WIFI antenna device in FIG. 1A with the coupling portion having different lengths.

FIG. 6 is an impedance plot of the WIFI antenna device 1 in FIG. 1A with the coupling portion 140 having different lengths. Referring to FIG. 6, a curve S4 represents a case that the coupling portion 140 is reduced by 1 mm relative to the original length of the coupling portion 140. A curve S5 represents a case that the coupling portion 140 is at the original length of the coupling portion 140. A curve S6 represents a case that the coupling portion 140 is increased by 1 mm relative to the original length of the coupling portion 140. In comparison with the curves S1, S2 and S3, it can be understood that an impedance of the WIFI antenna device 1 is significantly changed when the length of the coupling portion 140 is changed. Therefore, the impedance of the WIFI antenna device 1 may be adjusted by adjusting the length of the coupling portion 140, so as to make the impedance of the WIFI antenna device 1 and an impedance of the radio frequency transmitting line (not shown) matched in impedance. Moreover, as described in the embodiment of FIG. 5, the effect of the length of the coupling portion 140 on the three resonance frequencies is relatively small. Therefore, when the impedance of the WIFI antenna device 1 is adjusted by adjusting the length of the coupling portion 140, it does not worry about a large effect on the resonance frequencies. Because the coupling portion 140 is only used to adjust the impedance, a design of the WIFI antenna device 1 is simplified.

In the present disclosure, the coupling portion does not act as the radiation portion, the coupling portion only acts as a transferring element for energy and functions as adjusting the impedance; by adjusting the coupling portion, an impedance of a radiator at a resonance frequency can better controlled, so as to make the impedance of the radiator better matched with 50 ohm. Therefore, the impedance of the WIFI antenna device can be simply and rapidly adjusted to be within a desired range. Moreover, the WIFI antenna device of the present disclosure 1 can obtain more resonances, widen the bandwidth, and meet the broadband requirement of WIFI. Moreover, because the coupling portion of the present disclosure does not act as the radiation portion, the coupling portion nearly does not additionally occupy a space in the whole WIFI antenna device, a size of the WIFI antenna device is smaller.

In some existing WIFI antenna devices, the coupling portion acts as a radiation portion. However, this will be not beneficial to optimize the performance of the whole WIFI antenna device. Because impedances of the other radiation portions will be affected and even the return losses will be affected while the length of the coupling portion is adjusted, the existing WIFI antenna devices are complex in design, and a volume of the existing designed WIFI antenna device is relative large.

Figure 7:
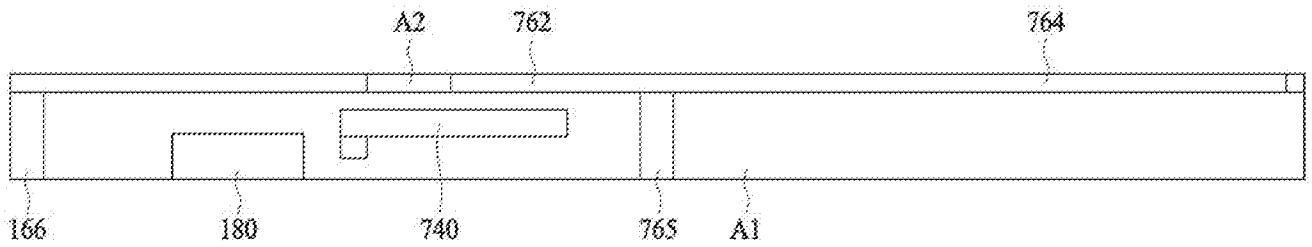
FIG. 7 is a diagrammatic view of another patterned conductive layer of an embodiment of the present disclosure.

FIG. 7 is a diagrammatic view of another patterned conductive layer of an embodiment of the present disclosure. Referring to FIG. 7, the patterned conductive layer is similar to the patterned conductive layer 13 of FIG. 3, and includes a coupling portion 740, a first radiation portion 764 and a second radiation portion 762.

The coupling portion 740 is similar to the coupling portion 140 of FIG. 3, but a difference lies in that the coupling portion 740 is a L-shape. The first radiation portion 764 and the second radiation portion 762 are respectively similar to the first radiation portion 162 and the second radiation portion 164 of FIG. 3, but a difference lies in that a part 765 shared by the first radiation portion 764 and the second radiation portion 762 is close to the coupling portion 740 relative to the shared part 165 of FIG. 3. In this case, the first radiation portion 764 is a radiation portion which determines a low frequency resonance point, the second radiation portion 762 is a radiation portion which determines a first high frequency resonance point. Moreover, a part (not indicated by any reference numeral) of the second radiation portion 762 is positioned above the coupling portion 740.

Figure 8:
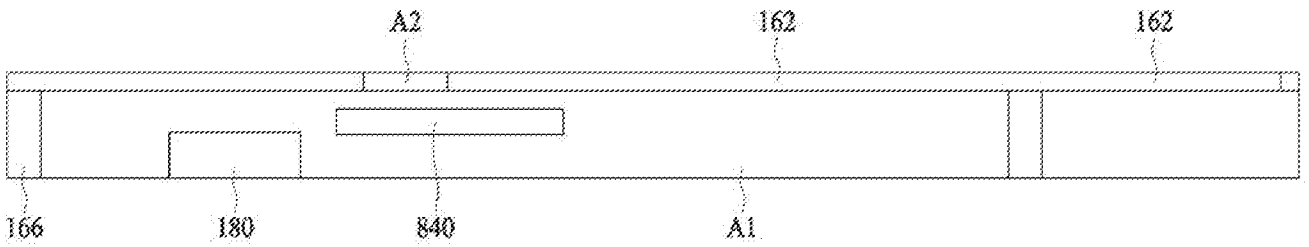
FIG. 8 is a diagrammatic view of still another patterned conductive layer of an embodiment of the present disclosure.

FIG. 8 is a diagrammatic view of still another patterned conductive layer of an embodiment of the present disclosure. Referring to FIG. 8, the patterned conductive layer is similar to the patterned conductive layer 13 of FIG. 3, but a difference lies in that the patterned conductive layer includes a coupling portion 840 having a minus sign shape.

Features of some embodiments are summarized in above content, so that a person skilled in the art may better understand various aspects of the disclosed content of the present disclosure. A person skilled in the art of the present disclosure shall understand that the disclosed content of the present disclosure may be easily used to design or modify other manufacturing approach or configuration and in turn to realize the same object and/or attain the same advantage as the embodiments of the present disclosure. A person skilled in the art of the present disclosure shall also understand that, such an equivalent approach or configuration cannot be departed from the spirit and scope of the disclosed content of the present disclosure, and a person skilled in the art may make various changes, substitutions and replacements, which are not departed from the spirit and scope of the disclosed content of the present disclosure.

What is claimed is:

1. A WIFI antenna device, comprising:

a carrier;

a grounding portion provided on the carrier;

a first radiation portion provided on the carrier and coupled to the grounding portion, the first radiation portion determining a low frequency resonance point of a radiation signal emitted by the WIFI antenna device, the low frequency resonance point defining a first bandwidth;

a second radiation portion provided on the carrier and coupled to the grounding portion, the second radiation portion determining a first high frequency resonance point of the radiation signal;

a third radiation portion provided on the carrier and coupled to the grounding portion, the third radiation portion determining a second high frequency resonance point of the radiation signal, the first high frequency resonance point and the second high frequency resonance point defining a second bandwidth which is greater than the first bandwidth; and a coupling portion coupling an electrical signal to the first radiation portion, the second radiation portion and the third radiation portion, the first radiation portion, the second radiation portion and the third radiation portion converting the electrical signal into the radiation signal, wherein the coupling portion is independent of any one of the first radiation portion, the second radiation portion, the third radiation portion and the grounding portion.

2. The WIFI antenna device according to claim 1, wherein a length of the coupling portion is less than one fourth of a wavelength corresponding to an operative frequency of the radiation signal.

3. The WIFI antenna device according to claim 1, wherein any one of the first radiation portion, the second radiation portion and the third radiation portion is wholly positioned on the same surface.

4. The WIFI antenna device according to claim 1, wherein the first bandwidth is 2.4-2.84 GHz, and wherein the second bandwidth is 4.90-5.85 GHz.

5. A WIFI antenna device, comprising:

a carrier;

a grounding portion provided on the carrier;

a first radiation portion provided on the carrier and coupled to the grounding portion, the first radiation portion determining a low frequency resonance point of a radiation signal emitted by the WIFI antenna device, the low frequency resonance point defining a first bandwidth;

a second radiation portion provided on the carrier and coupled to the grounding portion, the second radiation portion determining a first high frequency resonance point of the radiation signal;

a third radiation portion provided on the carrier and coupled to the grounding portion, the third radiation portion determining a second high frequency resonance point of the radiation signal, the first high frequency resonance point and the second high frequency resonance point defining a second bandwidth which is greater than the first bandwidth; and a coupling portion coupling an electrical signal to the first radiation portion, the second radiation portion and the third radiation portion, the first radiation portion, the second radiation portion and the third radiation portion converting the electrical signal into the radiation signal, wherein the coupling portion is not used to convert the electrical signal into the radiation signal.

6. The WIFI antenna device according to claim 5, wherein the first bandwidth is 2.4-2.84 GHz, and wherein the second bandwidth is 4.90-5.85 GHz.

7. A WIFI antenna device, comprising:

a carrier;

a grounding portion provided on the carrier;

a first radiation portion provided on the carrier and coupled to the grounding portion, the first radiation portion determining a low frequency resonance point of a radiation signal emitted by the WIFI antenna device, the low frequency resonance point defining a first bandwidth;

a second radiation portion provided on the carrier and coupled to the grounding portion, the second radiation portion determining a first high frequency resonance point of the radiation signal;

a third radiation portion provided on the carrier and coupled to the grounding portion, the third radiation portion determining a second high frequency resonance point of the radiation signal, the first high frequency resonance point and the second high frequency resonance point defining a second bandwidth which is greater than the first bandwidth; and a coupling portion coupling an electrical signal to the first radiation portion, the second radiation portion and the third radiation portion, the first radiation portion, the second radiation portion and the third radiation portion converting the electrical signal into the radiation signal, wherein a shape of the coupling portion is any one of a T-shape, a L-shape and a minus sign shape.

8. The WIFI antenna device according to claim 7, wherein the first bandwidth is 2.4-2.84 GHz, and wherein the second bandwidth is 4.90-5.85 GHz.

9. A WIFI antenna device, comprising:

a carrier;

a grounding portion provided on the carrier;

a first radiation portion provided on the carrier and coupled to the grounding portion, the first radiation portion determining a low frequency resonance point of a radiation signal emitted by the WIFI antenna device, the low frequency resonance point defining a first bandwidth;

a second radiation portion provided on the carrier and coupled to the grounding portion, the second radiation portion determining a first high frequency resonance point of the radiation signal;

a third radiation portion provided on the carrier and coupled to the grounding portion, the third radiation portion determining a second high frequency resonance point of the radiation signal, the first high frequency resonance point and the second high frequency resonance point defining a second bandwidth which is greater than the first bandwidth; and a coupling portion coupling an electrical signal to the first radiation portion, the second radiation portion and the third radiation portion, the first radiation portion, the second radiation portion and the third radiation portion converting the electrical signal into the radiation signal, wherein the first radiation portion and the second radiation portion define a T-shaped structure, and the third radiation portion is a L-shaped structure.

10. The WIFI antenna device according to claim 9, wherein the coupling portion respectively electrically couples with the L-shaped structure and the T-shaped structure.

11. The WIFI antenna device according to claim 10, wherein the coupling portion is parallel to a part of the first radiation portion, and wherein the coupling portion is parallel to a part of the third radiation portion.

12. The WIFI antenna device according to claim 10, wherein a length of the first radiation portion is one fourth of a wavelength corresponding to the low frequency resonance point, a length of the second radiation portion is one fourth of a wavelength corresponding to the first high frequency resonance point, and a length of the third radiation portion is one fourth of a wavelength corresponding to the second high frequency resonance point.

13. The WIFI antenna device according to claim 12, wherein the length of the first radiation portion is longer than the length of the second radiation portion, and wherein a vertical part of the T-shaped structure is shared by the first radiation portion and the second radiation portion.

14. The WIFI antenna device according to claim 12, wherein the coupling portion, the first radiation portion, the second radiation portion, the third radiation portion and the grounding portion are provided on a surface of the carrier.

15. The WIFI antenna device according to claim 14, wherein the grounding portion is electrically connected to a metal plate of an electrical product, the metal plate acts as a reference grounding of the WIFI antenna device.

16. The WIFI antenna device according to claim 9, wherein the first bandwidth is 2.4-2.84 GHz, and wherein the second bandwidth is 4.90-5.85 GHz.

17. A WIFI antenna device, comprising:

a carrier;

a grounding portion provided on the carrier;

a first radiation portion provided on the carrier and coupled to the grounding portion, the first radiation portion determining a low frequency resonance point of a radiation signal emitted by the WIFI antenna device, the low frequency resonance point defining a first bandwidth;

a second radiation portion provided on the carrier and coupled to the grounding portion, the second radiation portion determining a first high frequency resonance point of the radiation signal;

a third radiation portion provided on the carrier and coupled to the grounding portion, the third radiation portion determining a second high frequency resonance point of the radiation signal, the first high frequency resonance point and the second high frequency resonance point defining a second bandwidth which is greater than the first bandwidth; and a coupling portion coupling an electrical signal to the first radiation portion, the second radiation portion and the third radiation portion, the first radiation portion, the second radiation portion and the third radiation portion converting the electrical signal into the radiation signal, wherein the coupling portion is wholly positioned on a first surface of the carrier, and wherein the first radiation portion, the second radiation portion, and the third radiation portion each have a first part on the first surface of the carrier and a second part on a second surface of the carrier.

18. The WIFI antenna device according to claim 17, wherein, when the first surface and the second surface are developed on the same plane, at least one of the second part of the first radiation portion and the second part of the second radiation portion is positioned above the coupling portion.

19. The WIFI antenna device according to claim 17, wherein when the first surface and the second surface are developed on the same plane, the second part of the third radiation portion is positioned above the coupling portion.

20. The WIFI antenna device according to claim 17, wherein the first bandwidth is 2.4-2.84 GHz, and wherein the second bandwidth is 4.90-5.85 GHz.

21. A WIFI antenna device, comprising:

a grounding portion;

at least one first radiation portion being coupled to the grounding portion, the at least one first radiation portion determining a low frequency resonance point of a radiation signal emitted by the WIFI antenna device, the low frequency resonance point defining a first bandwidth;

at least one second radiation portion being coupled to the grounding portion, the at least one second radiation portion determining a high frequency resonance point of the radiation signal, the high frequency resonance point defining a second bandwidth which is greater than the first bandwidth; and a coupling portion coupling an electrical signal to the at least one first radiation portion and the at least one second radiation portion, wherein the coupling portion is not used to convert the electrical signal into the radiation signal, and wherein the at least one first radiation portion and the at least one second radiation portion convert the electrical signal into the radiation signal.

22. The WIFI antenna device according to claim 21, further comprising a carrier, wherein the grounding portion, the at least one first radiation portion and the at least one second radiation portion are provided on the carrier.

23. The WIFI antenna device according to claim 21, wherein the first bandwidth is 2.4-2.84 GHz, and wherein the second bandwidth is 4.90-5.85 GHz.

* * * * *